US005448641A

United States Patent [19]

Pintsov et al.

[11] Patent Number: 5,448,641

[45] Date of Patent: Sep. 5, 1995

[54] POSTAL RATING SYSTEM WITH VERIFIABLE INTEGRITY

[75] Inventors: Leon A. Pintsov, West Hartford, Conn.; Richard A. Connell, South Salem, N.Y.; Ronald P. Sansone, Weston; Alfred C. Schmidt, Wilton, both of Conn.

[73] Assignee: Pitney Bowes Inc., Stamford, Conn.

[21] Appl. No.: 133,398

[22] Filed: Oct. 8, 1993

[51] Int. Cl.[6] ..... H04K 1/00

[52] U.S. Cl. ..... 380/51; 380/23; 380/28; 380/43; 380/55

[58] Field of Search ..... 380/30, 23, 43, 51, 380/55

[56] References Cited

U.S. PATENT DOCUMENTS

| | | | |
|---|---|---|---|
| 3,705,384 | 12/1972 | Wahlberg | 340/149 |
| 3,798,603 | 3/1974 | Wahlberg | 340/149 |
| 4,168,533 | 9/1979 | Schwartz . | |
| 4,290,105 | 9/1981 | Cichelli et al. | 364/200 |
| 4,301,507 | 11/1981 | Soderberg et al. . | |
| 4,614,970 | 9/1986 | Clupper et al. | 358/120 |
| 4,675,841 | 6/1987 | Check, Jr. et al. . | |
| 4,757,532 | 7/1988 | Gilham . | |
| 4,757,537 | 7/1988 | Edelmann et al. . | |
| 4,773,042 | 9/1988 | Edwards | 364/900 |
| 4,775,246 | 10/1988 | Edelmann et al. . | |
| 4,817,042 | 3/1989 | Pintsov . | |
| 4,829,443 | 5/1989 | Pintsov et al. . | |
| 4,831,555 | 5/1989 | Sansone . | |
| 4,853,864 | 8/1989 | Hart et al. | 364/464.02 |
| 4,853,961 | 8/1989 | Pastor . | |
| 4,855,920 | 8/1989 | Sansone et al. . | |
| 4,893,338 | 1/1990 | Pastor . | |
| 4,900,904 | 2/1990 | Wright et al. . | |
| 4,926,479 | 5/1990 | Goldwasser et al. | 380/23 |
| 4,934,846 | 6/1990 | Gilham . | |
| 4,995,082 | 2/1991 | Schnorr | 380/23 |
| 5,048,086 | 9/1991 | Bianco et al. | 380/28 |
| 5,073,935 | 12/1991 | Pastor | 380/30 |
| 5,173,862 | 12/1992 | Fedirchuk et al. . | |
| 5,181,245 | 1/1993 | Jones . | |
| 5,191,533 | 3/1993 | Haug . | |
| 5,210,796 | 5/1993 | Lipner et al. | 380/23 |
| 5,222,140 | 6/1993 | Beller et al. | 380/30 |
| 5,297,206 | 3/1994 | Orton | 380/30 |
| 5,308,932 | 5/1994 | Manduley et al. | 177/25.15 |
| 5,322,977 | 6/1994 | Manduley et al. | 177/25.15 |
| 5,324,893 | 6/1994 | Manduley et al. | 177/25.15 |
| 5,343,527 | 8/1994 | Moore | 380/4 |

OTHER PUBLICATIONS

Contemporary Cryptography by G. Simmons, IEEE Press, 1992 Table of Content and pp. 177–288, 345 and 391–403.

American National Standards, X9.30–1993, Public Key Cryptography Using Irreversible Algorithms For the Financial Svc.

Checking The Correctness of Memories, Proceedings of 31st Symposium on Foundations of Computer Science, Oct. 1990.

*Primary Examiner*—David C. Cain

*Attorney, Agent, or Firm*—David E. Pitchenik; Charles R. Malandra; Melvin J. Scolnick

[57] ABSTRACT

A data center provides a rate table to a user. The rate table is communicated to the mailer along with a hash code that is based on information from the rating table. The hash code provides a unique number based on the rating table. The user within a secure device and to which the rate table is loaded regenerates the hash code based on the information received from the rate table and compares the transmitted hash code with the generated hash code. The comparison verifies that the rate table data has not been intentionally or unintentionally corrupted. The transmitted hash code may be encrypted by the data center and when received decrypted by the mailer. The encryption decryption process provides authenticity of the data center if desired. The generation of the hash code and the comparison with the transmitted hash code can be initiated prior to postage printing and used to insure proper rating. Printing is enabled only after the rating process has been properly implemented. The hash code and rating information may be printed on the mail piece such that a verifying party can reconstruct the rating process and determine if any rating inaccuracy occurred. Various rating inaccuracies for a particular user can be stored by the verging party to detect a recurrence of rating errors. Rating profiles for particular users or group of users may be stored to enable generation of user profiles.

55 Claims, 5 Drawing Sheets

POSTAL RATING SYSTEM WITH VERIFIABLE INTEGRITY

FIELD OF THE INVENTION

The present invention pertains to rating of mail for postal system and, more particularly, to a postal rating system having verifiable integrity determinable from the information printed on a mail piece.

BACKGROUND OF THE INVENTION

Various postal services and private carrier services throughout the world have developed rate tables for mail and parcels. These rate tables specify the rate for any given mail piece (hereinafter intended to include parcels and other mailable items as well).

The rating may involve the desired class of service, such as first class or third class mail in the United States, the weight of the mail, the size of the mail, the distance of which the mail is to be sent, the level of service such as Express Mail involving delivery the next day, and/or a discount associated with a level of work sharing. Each postal service and each private carrier service usually establish their own rate tables for mail and parcels. Postal service as used herein is intended to apply equally and mean both governmental or other postal services and also private carrier services. Similarly, postal value as used herein are intended to apply equally and mean both governmental or other postal values and also private carrier service delivery charge and other values.

To facilitate a mailer applying proper postage or other charges (such as, for example, insurance or certified delivery or return receipt, etc.) to a mail piece or to a tape to be adhered to a mail piece, various devices have been provided such as scales which include rate tables to provide a visual indication to the user of the appropriate postage for the given mail piece to be deposited with the postal service. In some instances, these weighing devices having rating tables allow for the automatic setting of the postage meter print wheels wherein the scale includes a connection to an electronic postage meter and conveys setting information. This now enables a more rapid printing of postage and processing of the mail. One example of such a system is the Pitney Bowes PARAGON mailing system wherein mail is weighed and the postage meter print wheels automatically set for imprinting of the proper postage on a mail piece. Another system such as that disclosed in U.S. Pat. No. 4,855,920 for POSTAGE ACCOUNTING DEVICE provides a secure accounting unit with a memory including, a rate charge of postage rates for different classes of mail. Yet another system is disclosed in U.S. Pat. No. 5,191,533 for FRANKING MACHINE wherein rate tables are stored in a meter and are employed to set the printing mechanism to a desired amount.

It has been recognized that a mail piece may be imprinted with an improper postage amount. This can be due to a number of different factors such as the utilization of a wrong rate table, the utilization of an obsolete rate table, on the input of inaccurate data for the rating process. One example would be the input of an incorrect size of the mail piece (where the size of the mail piece is a rating factor).

SUMMARY OF THE INVENTION

It has been discovered that a rating system can be provided which allows verification of the integrity of the rating process.

It has further been discovered that it is possible to allow verification in a manner which determines that an appropriate rate table has been employed and to identify the reason for improper rating of the mail.

The present invention facilitates the entry of rate tables (or their equivalent) into a postage evidencing system such as a postage meter. It also increases the security of mail rating and provides assistance in determining that a mail piece was securely rated and that the right rate table was used in the rating process.

In accordance with the present invention a data center (which may be run by a third party or by the postal service) provides a rate table to a user. The rate table is publicly available data as to how mail should be rated for various different rating parameters. The rate table is communicated to the mailer along with a code. The code is based on information from the rate table. The code provides a unique number based on the rating table provided. The algorithm within a secure device into which the rate table is loaded regenerates the code based on the information from the received rate table and compares the transmitted code with the generated code. The comparison results in an appropriate match if the rate table is authentic and if the source of the rate table is the appropriate sending authority. This both authenticates the source of the rate table and the integrity of the data received.

In accordance with a feature of the present invention printing by the postage evidencing device, such as a postage meter, is not enabled until the integrity of the data stored within the postage evidencing device memory for the rate table is verified as being correct. This is done by recomputing the code for the rate table and comparing the code for the rate table with a stored code received from the data center when the table was originally transmitted which has been stored in a nonvolatile memory. If the two codes are the same, printing is authorized.

In accordance with still a further feature of the invention the code (which may be a "hash" code) is printed along with the rating parameters on the mail piece such that a verifying party can reconstruct the rating process and determine if rating inaccuracy occurred and/or if the rate table employed in rating is valid for the date of the postage imprint. The code may be printed in encrypted form on the mail piece and the encrypted code may be printed along with other encrypted information on the mail piece. Alternatively the hash code may be combined with other information such as the postal value and postage evidencing device identification and the combined result then encrypted and printed on the mail piece.

In accordance with yet another feature of the present invention the rating inaccuracies for a particular user can be stored by the verifying party to detect a recurrence of rating errors and to automatically initiate appropriate corrective and/or other actions should, for any given mailer or group of mailers, rating errors of particular categories exceed certain threshold levels.

In accordance with still another feature of the present invention the rating profile for a particular user or a group of users is stored by the verifying party to enable the generation of a profile of a mailer or a group of mailers to provide business data for marketing to such mailer further postal services and/or informational reports based upon verified mailing patterns, such as rate, level of service, mail destination, distribution and the like.

BRIEF DESCRIPTION OF THE DRAWINGS

Reference is now made to the following figures wherein like reference numerals designate similar elements in the various views and in which.

GENERAL OVERVIEW

Figure 1:
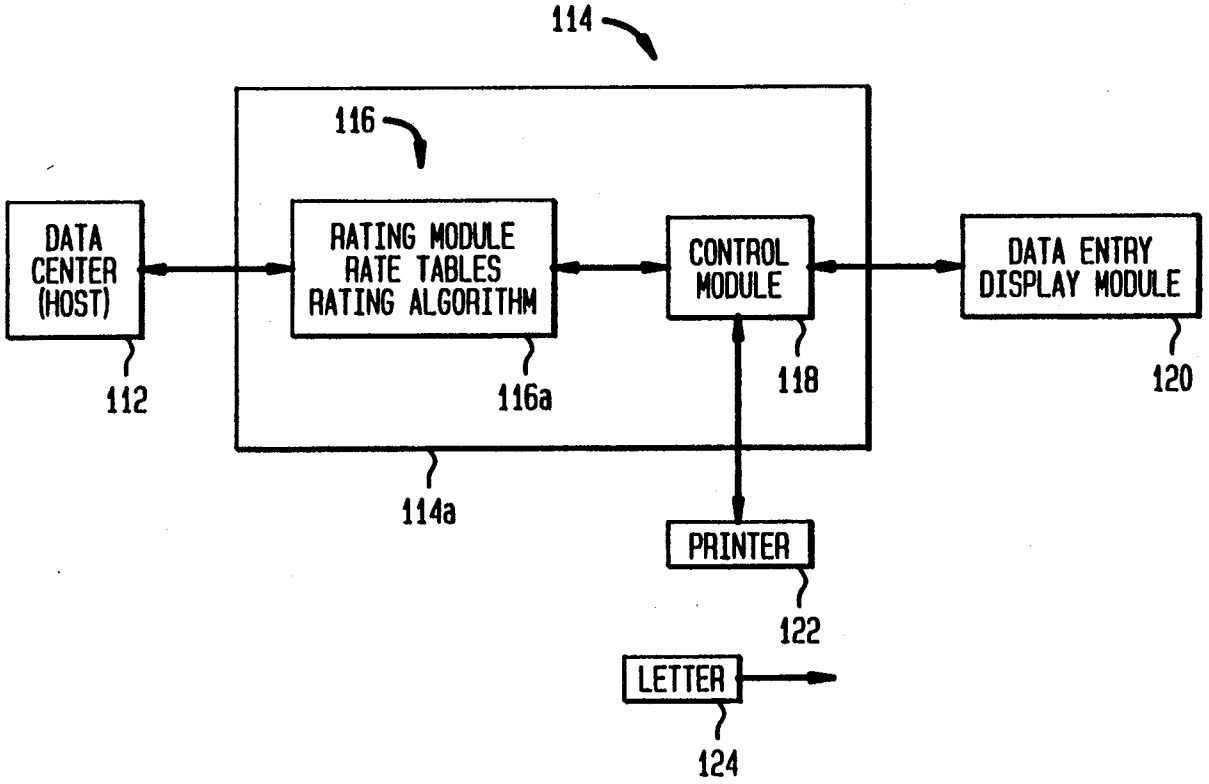
FIG. 1 is a mailing system employing a secure rating module allowing verifiable rating integrity.

The postage value (rate) for every mail piece may be encrypted together with other data to generate a digital token. A digital token is encrypted information that helps to authenticate the value or other information imprinted or to be imprinted on a mail piece. Examples of systems for generating and using digital tokens are described in U.S. Pat. No. 4,757,537 for SYSTEM FOR DETECTING UNACCOUNTED FOR PRINTING IN A VALUE PRINTING SYSTEM; U.S. Pat. No. 4,831,555 for UNSECURED POSTAGE APPLYING SYSTEM; and U.S. Pat. No. 4,775,246 for SYSTEM FOR DETECTING UNACCOUNTED FOR PRINTING IN A VALUE PRINTING SYSTEM. The entire disclosure of these three patents is hereby incorporated herein by reference.

As a result of the digital token incorporating encrypted postage value, altering of the printed postage value in a postal value revenue block is detectable by a standard verification procedure. Thus, to underpay postage, an attempt may be made to interfere with the rating process (as opposed to the resulting printed postage value).

Rating with verifiable integrity in accordance with the system described herein helps to: 1) provide diagnostics to the party conducting verification to enable detection of inadvertent misrating of mail pieces; and, 2) provide evidence to the party conducting verification of deliberate underrating of mail pieces.

Rating input parameters may be entered into a system manually or automatically or partially manually and partially automatically. For example, sensory data such as weight, size of mail pieces and presence of a barcode can be automatically entered while desired level of service or mail class can be keyed in manually or entered by default from a file. Alternatively all rating parameters can be entered into the system manually. The process of computing the postal value or (rate) is based on calculations involving input rating parameters and a rate table. The process of mail rating, however, can produce incorrect results. The following are such examples:

A) Entered incorrect rating parameter or parameters (e.g. wrong entered weight or size).

B) The rate table is obsolete or the wrong rate table.

C) The rate table is incorrect because it has been deliberately altered.

D) Entered input rating parameter or parameters are incorrect and the rate table is obsolete or incorrect.

E) Entered input rating parameter or parameters are incorrect and the rate table has been deliberately altered.

It should, of course, be recognized that the above examples can be combined to produce additional examples such as A and B or A and C or B and C or A and B and C.

The case of inadvertent misrating can occur due to incorrectly entered data, or obsolete or incorrect rate table or both. In the above examples, the case of inadvertent misrating is equivalent to examples A, B or D. In this case printing values of rating input parameters and rate table identification in the postal revenue block (or other area) on a mail piece, provides required diagnostic data for a verifying party. Upon entering values of input parameters and rate table identification from the postal revenue block into a computer, the verification party is able to reproduce the rating process that took place during mail rating by the mailer. The verification party is also able to independently determine correct rating parameters and compute a correct rate. If the two rates obtained do not match, a pairwise comparison of rating parameters and rate table identification helps provide the desired diagnostic as to the reason for the misrating of the mail piece. In this manner, detecting the deliberate entering of incorrect rating parameters is also facilitated.

Examples C and E are cases of deliberate underrating. For the purpose of providing evidence of deliberate underrating it is desirable to help establish that the rate computation was altered by changing of the rate table or using a wrong rate table. In the case of example C or E, a user of a postage evidencing device might attempt to change certain memory locations where particular postal rates are stored. This can be prevented by using well known techniques such as a non-volatile memory (NVM) within a secure postage evidencing device housing for the storage of the rate table as it was just described. The secure housing is both resistive to tampering such as by the use of break off screws and also may provide forensic evidence of the fact of tampering. If this process is too expensive, especially for large rate tables or where regular updates of NVM in a secure manner are proved to be unacceptably more expensive than updates of regular type memory, a modification of present invention described below can be applied that detects the alteration of a rate table rather than preventing it. From the security point of view, the ability to detect the reason for misrating serves as an excellent deterrent measure since the reason for misrating can be proven and also since deliberate misrating of mail may constitute a criminal offense.

Figure 2:
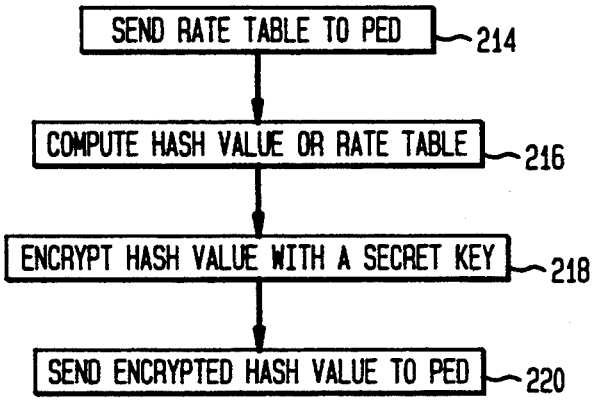
FIG. 2 is a flow chart of the activities of the data center involved with transmitting to a secure rating module, a rate table in accordance with the present invention.
Figure 3:
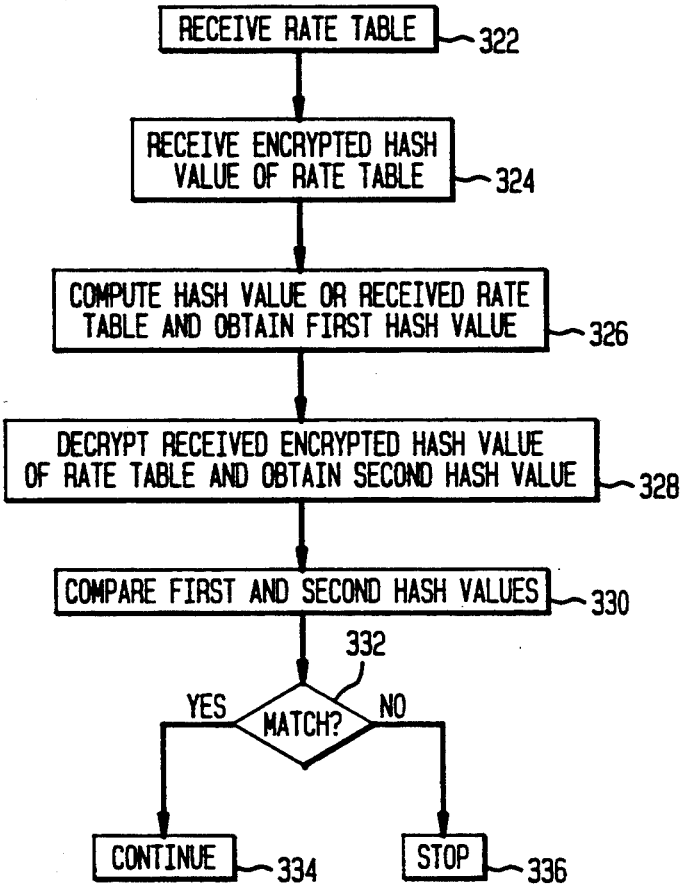
FIG. 3 are the activities at the postal evidencing device involved with processing a received rate table and the process by which verification of the integrity of the rate table data and the authenticity of the data center is established in the postage evidencing device.

The rate table may be loaded into the RAM memory of a postage evidencing device (rather than a secure non-volatile memory) from a data center as is shown in FIG. 2 and FIG. 3 (which are described in detail hereinafter). The process insures the integrity of the rate table received from the data center by the postage evidencing device.

Another way to provide verifiable integrity of the mail rating process is to compute the hash value of the entire rate table (or its specified portion) upon each access to the rate table. Immediately after this hash value has been computed it is sent to a private (secure), non-volatile memory. This private memory can be accessed only by the encryption module of the postage evidencing device. This encryption module encrypts the hash value of the rate table actually used for rating, together with other information, into digital tokens. In other words this hash value serves as one of the elements of the postal data used by the digital token transformation to produce the encrypted information to be printed on a mail piece. The overall operation provides a digital signature of the rate table actually used by employing techniques known in modern cryptology (see for example Contemporary Cryptology, The Science of Information Integrity, ed. G. Simmons, IEEE Press, 1992).

Yet another way to detect deliberate alteration of the rate table is to use a function such as a hash function parameterized by a secret key. In this case, just as in the previously described case, the hash value of the entire rate table (or a suitable portion thereof) is computed after each access to the rate table. The hash value in this case is a function of a secret key and thus can not be computed without knowledge of this key. When the hash value is computed a small or truncated portion of it can be printed in the postal revenue block as a rate table identification. Typically, two decimal digits would be sufficient (since it gives a potential adversary only 1 chance out of 100 to guess the right value of the rate table identification.) These two decimal digits would appear completely random to any observer without knowledge of the secret key. These two digits (or any larger number of such digits) may be termed the rate table digital token. It may be a part of the digital token previously described. The hash function parameterized by a secret key can be computed as a Message Authentication Code (MAC) which is widely used in the financial services industry.

DETAILED DESCRIPTION OF THE PREFERRED EMBODIMENT

Reference is now made to FIG. 1. A data center 112 contains various rate tables published by a postal service or other carrier. The rate tables provide the delivery charges or postal fees for various types of services depending on the various parameters for each category of service. For example, a rate table may exist for the United States Postal Service first class mail, providing rates for first class mail, depending upon the different weights associated with the mail piece. In contrast, rates for a parcel may include the ZIP code or zone code as part of the rating parameters to determine the appropriate fee or payment for delivery of such parcel. These rate tables are communicated, as for example, by modem, by disk, by magnetic or smart card or by other suitable means, to a postage evidencing device shown generally at 114. The postage evidencing device may be a traditional electronic postage meter such as disclosed in U.S. Pat. No. 4,675,841 for MICROCOMPUTERIZED ELECTRONIC POSTAGE METER SYSTEM; U.S. Pat. No. 4,301,507 for ELECTRONIC POSTAGE METER HAVING PLURAL COMPUTING SYSTEMS; other types of metering system for evidencing postage such as, for example, as disclosed in U.S. Pat. No. 4,757,537 for SYSTEM FOR DETECTING UNACCOUNTED FOR PRINTING IN A VALUE PRINTING SYSTEM; or U.S. Pat. No. 4,934,846 for FRANKING SYSTEM. The postage evidencing device, (which may be a personal computer type metering system, however,) should preferably have the ability to print variable information on a mail piece to provide the requisite information for verification by a verifying authority as will be hereinafter explained.

The postage evidencing device 114 includes a rating module 116. The rating module stores the rate tables which are communicated to the the postage evidencing device from the data center 112. The rating module 116 is operatively connected to a control module 118 which would include a central processing unit and various other suitable electronic components and program control devices such as programmable read only memories (PROMs), random access memories (RAMs) and non-volatile memories (NVMs) for storing various postal and accounting data. Many system architectures are suitable for the present invention. For example, the accounting circuitry and NVM(s) can be part of the rating module within the secure housing **116*a* (tamper resistant device housing) or within a separate secure housing. The housing 114*a*** may be a secure housing, or distributed processing systems may be employed.

A data entry module 120 is provided to allow a user to enter information into the postage evidencing device 114. This data may include, for example, the weight, size, class of service and other data concerning the mail piece and relevant to the rating and mail finishing processes. Examples of the types of data that can be entered by a user includes mail class, weight, dimension (length, width, or thickness or all of them), desired service level, work share level (for the United States Postal Service these may include indication of due presence of certain bar code, ZIP code, or ZIP+4 code, ZONE code or presort level, etc.). Yet another type of data that could be entered could be, for example, a graphics code for the graphics to be printed. It should be recognized that any other factors that are deemed to be relevant by a particular postal service carrier in the rating process may be enterable by the user through the data entry module 120. The entry can be manual or automatic; the data may be from a computer system associated with creating or tracking the mail pieces or it may be scanned or measured from the mail piece itself. A printer 122 such as a thermal printer or ink jet printer or pin printer or laser printer is coupled to the control module.

It should be recognized that the rating process can be viewed as mapping of a set of input parameters (which can be called a vector) into a set of rational numbers which represents the postal rates. This can be viewed as mapping f from a set of input vectors {I} into a set a numbers R which represents the postal rates. As an example, the input vector (that can consist of such components as: a) two ounce weight category, b) zone three, and c) a size indicator) can be mapped into a unique and specific rate, for example, 43 cents. As each of the vector components change, the rate changes. If the size indicator is eliminated and the mail piece was not, for example, oversized, the rate, for example, could diminish to a lower rate. A further example would be a one ounce letter with no zone category and no oversize category and no presort or other worksharing that would yield still a different rate. Thus, the various vectors (rating parameters) which constitute the input for the rate table determine the rate. As vectors change the rates may go up or down depending on the particular rate table involved. These parameters for rating vary from postal service to postal service and carrier to carrier. The rating parameters can be any number of parameters depending applicable rating criteria. These rating parameters will lead ultimately to a single price that is to be paid as determined by the appropriate rate table. Thus, input "vectors" can be utilized as the rate table input to map onto the rate table in the postage evidencing device or system rating module to establish the actual postage to be imprinted on the mail piece. It should be specifically recognized that the establishing of the postal value to be imprinted on a mail piece may require the utilization of more than one rate table. For example, a rate table may exist for delivery charges, and a separate rate table for mail piece insurance charges.

Another explanation of how the rating process can be viewed as a mapping from a set of input vectors {I} into a set of numbers R which represent postal rates is as follows: An input vector is an ordered set of numerical parameters:

$$I=a_1a_2, \ldots, a_n)$$

where $a_1$ is the weight of the mail piece,
$a_2$ is the length of the mail piece,
$a_3$ is the width of the mail piece,
$a_4$ is the thickness of the mail piece,
$a_5$ is the desired level of service (including delivery time, special processing request such as registered mail etc.)
$a_6$ is a postal code of the origination address
$a_7$ is a postal code of the destination address
$a_8 \ldots a_n$ are other relevant parameters including the level of worksharing (presort, prebarcoding etc.)

Again, the parameters of I form an exhaustive set in a sense that it can include all relevant parameters for any postal system in any country.

The mapping from {I} into R is defined by the process of computing a rating function. This can be either an algorithmic computation or (the most common case) a special algorithm called the table look up wherein a pointer is generated that points to the particular code in a look up table for the rate based on the input vector.

The integrity of the rating process involves the integrity of computing the rate for any given mail piece. That is, for example, the integrity in employing the computational algorithm such as, the integrity in utilizing a look up table. Integrity or the rating process requires the use of securely correct rates.

In one embodiment the computational algorithm itself and/or the rate table are encrypted by using a secret or public key encryption system transmitted to the rating module 116 of the postage evidencing device 114. The decryption algorithm can be initiated upon receiving a secret key or other private information by the rating module 116. The transmission can be accomplished via a modem in a traditional way known to those skilled in the art, or by direct phone contact with a user and hand data entry. Additionally, of course, all of the previously noted communication techniques for transmitting data can be employed. In the case of a stand alone system, not involving a data center, the decryption key must be stored in a physically protected memory location in the postage evidencing device (e.g. in the rating module). The encryption and decryption can be by any number of well known encryption/decryption techniques such as the Data Encryption Standard (DES) or the RSA system.

Upon receiving the rate table(s) and calculation (computation) algorithm, and decrypting them, if necessary, the verification of the rate table authenticity can be made as will hereinafter be explained. The calculation algorithm and rate table are stored in a protected data memory such as in a secure non-volatile memory. Both the rate table and the calculation algorithm have unique identifiers. The identifiers can be in the form of a code which also may include data indicative of the date of issue and/or the end date (time period) after which the calculation algorithm and rate table can no longer be considered valid. Additionally, data concerning the source of the data itself (the data center from which the data came) may also be included.

The task of mail rating can be accomplished in the following manner. First, the operator of the postage evidencing device (e.g., postage meter or shipping or weighing system) enters the input parameter $I=(a_1, a_2, \ldots a_n)$ of the mail piece to be processed. Alternatively, an automatic device (such as a mailing machine) can automatically measure some or all of the components of the vector I and enter it into the rating module; other components can be prestored and used as default parameters. In either case, the rating module performs a consistency check of the vector I in order to determine that the vector I can serve as a legitimate input for the rating process. Thus, all of the input parameters for rating are verified to check their legitimacy or logical consistency given the rating system being employed. (For example, entering a weight of three pounds for a letter class mail piece would not pass the test of consistency in the United States.) Then, the supervisory routine of the rating module invokes the rating algorithm and the rate table. This is done using one of the techniques well known in the art such as authentication channels, e.g. symmetric or asymmetric cipher exchange (see, for example, a book entitled Contemporary Cryptology, ed. G. Simmons, IEEE Press 1992). After the rate R is calculated the following data elements are passed to the postal rating revenue block formatting module (here the indicia or imprint is defined as a printed image that is to be used for evidencing postage payment). This can include rates (in the appropriate units of currency), identification of the rate table, identification of the rate calculation algorithm, and the rate input vector $I=(a_1, a_2, \ldots a_n)$. Some or all of these items of information are printed by the printer 122 on the mail piece 124 to enable verification. One verification approach involving video recording of mail pieces for later processing is disclosed in U.S. Patent Application of Robert A. Cordery and Leon A. Pinstov, application Ser. No. 08/077,667, filed Jun. 18, 1993 for MAIL PROCESSING SYSTEM INCLUDING OFF-LINE VERIFICATION and assigned to Pitney Bowes Inc.

The postal revenue block (indicia) formatting module combines these data elements with others (such as, for example user device identification, date/time stamp, postal codes of origination and destination, and, possibly others, as for example suggested in the above-identified three U.S. patents which have been incorporated herein by reference or also in U.S. Pat. No. 4,853,961 for RELIABLE DOCUMENT AUTHENTICATION SYSTEM, the entire disclosure of which is also hereby incorporated herein by reference. This generates a printable digital image of the postal revenue block.

The authentication channel for rate table communications between the data center 112 and the postage evidencing device 114 will now be described. The authentication channel is well known in the art (see for example Contemporary Cryptology ed by G. Simmons, IEEE Press, 1992). The authentication channel involves two communicating parties who would like to authenticate each other before exchanging any sensitive messages. The parties can be a data center and a postage evidencing device.

The data center would operate to send a rate table to a postage evidencing device via a communications channel (phone line or other transmission). The secret information, (for example, a secret key in a case of a secret key based protocol), is stored both at the data center and in the postage evidencing device. Alternatively, in a public key system one of the parties (for example, the data center,) knows a secret key, and the other party, (here, the postage evidencing device), knows a matching public key. The protocol for mutual authentication requires that the data center first sends information in plain text and then the same information encrypted with its secret keys. The postage evidencing device upon receipt of both messaged deciphers the encrypted message with its secret (or public key) and compares it with its plain text version. If a match is made, the data sender is authenticated, since only the sender knew the secret key. Similarly, the postage evidencing device can send two messages, plain text and encrypted message to authenticate itself to the data center if needed. In mailing applications this may not be needed.

After such authentication, if it is desired, the data center 112 transmits a rate table and/or calculation algorithm. This transmission, however, requires a data integrity. That is, that the rate table and/or calculation algorithm should arrive unmodified. Assurance is needed that the rate table and/or calculation algorithm arrives exactly as it was sent and that it has not been corrupted, intentional or unintentionally. In order to accomplish this, the data center 112 first generates a hash value (message digest) of all, or some specified portion of, the data contained in the rate table and/or of the calculation algorithm to be sent. The rate table and/or calculation algorithm can then be sent as an ASCII or other type of file. The hash function applied to this data produces a hash value (message digest) which is indicative of the content of the rate table and/or calculation algorithm and yet is considerably reduced in data size. As used herein hash function is a well known function which possesses at least two properties. It is computationally difficult to (i) recover a message corresponding to a given message digest and (ii) to find two different messages which produce the same hash value (message digest). Some well known hash functions are described in American National Standard X9.30—1993, Public Key Cryptography Using Irreversible Algorithms For The Financial Services Industry: Part 2: The Secure Hash Algorithm (SHA). It should be noted that there are other publicly available hash functions that can be implemented for the purpose of the present invention. As for example, one formal definition is set forth in Contemporary Cryptology by G. Simmons, IEEE Press 1992 at page 345, and yet another definition is that a hash function h is a function that satisfies the following properties: 1) it is capable of converting a file F of arbitrary length into a fixed-length digest h (F); 2) h must be "one way", that is, given an arbitrary value y in the domain of h, it must be computationally infeasible to find file F such that h (F)=y; and 3) h must be "collision free", that is it must be computationally infeasible to construct two different files $F_1$ and $F_2$ such that h ($F_1$,)=h ($F_2$).

Since the data (the rate table and/or calculation algorithm) being transmitted to the postage evidencing device 112 is publicly available information, it is not necessary to encrypt the information and prevent unauthorized decryption since it is not important to protect secrecy of the information itself. Upon calculation of the hash value (message digest) of the rate table and/or the calculation algorithm the data center encrypts the hash value (message digest), with its secret key (for both public and secret key systems) and sends the encrypted message to the postage evidencing device 114. The postage evidencing device 114 receives the encrypted hash value ("signature"), and decrypts it with its secret or public key as the case may be, thus obtaining the plaintext hash value (message digest). The postage evidencing device 114 then independently computes the hash value (message digest) of the received rate table and/or calculation algorithm using the same hash function. The hash algorithm employed may be one in the public domain, however the algorithm resides both at the data center 112 and at the postage evidencing device 114. If the two hash values received from the data center and the hash value computed in the postage evidencing device match each other, the integrity of the rate table received and stored in the postage evidencing device rating module 116 is assured. Thus, the integrity of the stored rate table and/or calculation algorithm is verified.

Both steps (authentication of the data center and verifying the integrity of the rate table and/or calculation algorithm received) can be combined. To do so, the data center 112 simply sends two messages to the postage evidencing device 114: the rate table and/or calculation algorithm in plain text and the rate table and/or calculation algorithm encrypted with the secret key. Thus, the authenticity of the sender and the verification of the message can be achieved in one step.

Figure 4:
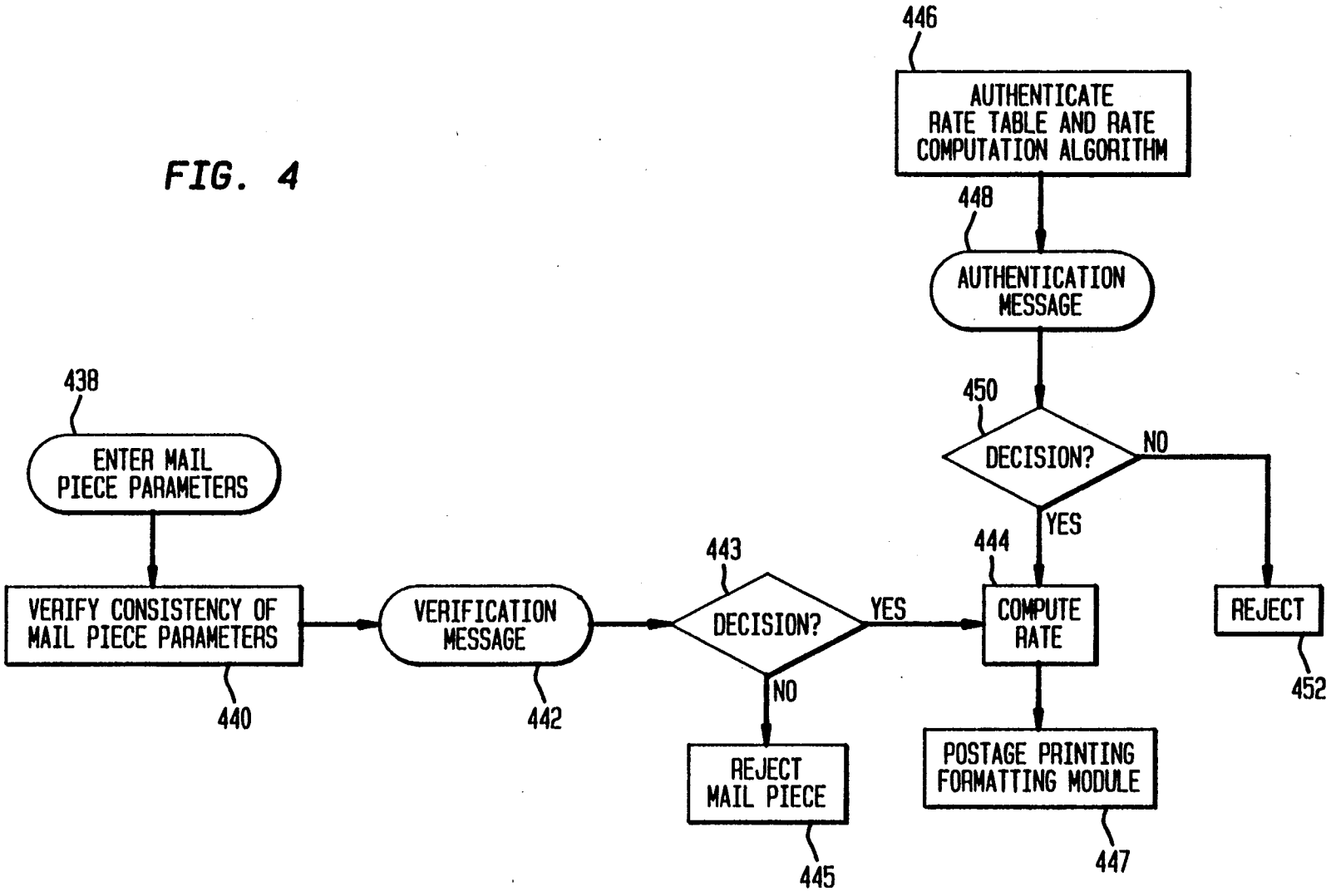
FIG. 4 is a flow chart within the postage evidencing device for rating a mail piece and printing the appropriate Postal Revenue Block on the mail piece.

A description now follows in connection with FIGS. 2, 3 and 4 of the activities of a rate table/calculation algorithm at the data center 112 and at the postage evidencing device 114.

Reference is now made to FIG. 2. The data center 112 sends the rate table and/or calculation algorithm to the postage evidencing device 114 at 214. Thereafter, the data center 112 computes the hash value (message digest) of the rate table at 216. The hash value is then encrypted by the data center 112 at 218. The encrypted hash value is transmitted to the postage evidencing device 114 at 220.

Reference is now made to FIG. 3. The rate table is received by the postage evidencing device 114 at 322. The postage evidencing device 114 also receives the encrypted hash value of the rate table at 324. The postage evidencing device 114 then computes the hash value (message digest) of the received rate table and obtains a first hash value at 326. The postage evidencing device 114 decrypts the received encrypted hash value of the rate table at 328. This provides a second hash value at the postage evidencing device 114.

A comparison is made at 330 of the first hash value which has been computed by the postage evidencing device 114 and the second hash value which has been obtained by decryption. If a match is made at 322, the process continues at 334 and may ultimately result, when required, in printing of the postal revenue block. This would occur if all other conditions are appropriate in the postal evidencing device, as for example, adequate funds are available for postage printing. If a match has not been made at 332 the process is stopped at 336, since the integrity of the received rate table and/or calculation algorithm has not been verified. The postage evidencing device 114 may be inhibited from further operation, if desired, requiring physical inspection and servicing. Alternatively the system may be allowed to operate but an error flag set in the postage evidencing device 114 and printed on a mail piece by printer 122 for detection at a mail piece verification facility. Several attempts to verify the integrity of the received rate table and/or calculation algorithm may be allowed before the postage evidencing device is locked up.

The value of the hash function (or a part thereof) can serve as a unique rate table identification number. This unique identification number can be associated with the validity period of the rate table in a one to one fashion. For example, the rating authority, (the postal service or other carrier) provides identification for each new rate table and creates a table where both information as to the rate table identification and corresponding validity periods are stored. A simple table look up allows the verifying facility, mailer or third party to recover the validity period. This is useful for the postage payment verification process. In this instance by utilizing the unique identification number, (as for example a hash value) the verification service can determine the specific postal or carrier rating table utilized and thus can determine whether the rating table used by the mailer in calculating the mail piece rate and thus postage value imprinted on the mail piece was within the validity period. Moreover, it should be expressly recognized that it may be desirable to encrypt the printed hash function or have the hash value parameterized by a secret key. Thus the printed encrypted or parameterized value of the hash function on the mail piece is not subject to attack and can itself be verified. This technique of imprinting an encrypted or parameterized hash value on the mail piece can be employed with each of the various aspects and embodiments of the present invention.

Enhanced verifiable integrity of the rate computation itself is also provided by the present system. There are a number of ways that the system can compute rates with verifiable integrity. Depending upon the particular implementation, there can be different systems requirements, as for example the speed of the processor and the storage capabilities of the RAMs and NVMs.

One way to achieve this enhancement of the integrity of the mail rating process is to load the rate table (as previously described) together with its identification into the non-volatile memory of the rating module 114. The system requires access to and use of the rating table and/or calculation algorithm before enabling printing of the postal revenue block (meter indicia). This may be accomplished, for example, by precluding access to the postal revenue block formatting software module until the rating vectors have been entered and the rating process completed. Another manner in which this can be accomplished is to load the rate table and/or calculation algorithm together with its unique identification into the non-volatile memory of the rating module 116. The postage evidencing device 114 central control program operates such that only access to this non-volatile memory and the appropriate rating process memory locations therein can trigger printing of the postal revenue block (meter indicia). Postal value thus cannot be printed without access to the rate table and/or calculation algorithm.

Another way to provide enhanced (verifiable) integrity of the mail rating process is upon entering required rating input parameters, the postal evidencing device 114 invokes a control routine which computes a pointer to the rate table for a given mail piece. This can be done by formatting the rate table first as a multi entry numeric table or multidimensional array having a number of dimensions equal to the number of input parameters. The pointer can be a concatenated string of numbers or symbols partitioned into sections indicative of the appropriate location in the array. The number of sections is equal to the number of input parameters.

For example, if the rate table has only three weights, 1, 2 and 3 ounces, two dimensional indicators, (zero being indication of regular size and one being indicative of oversized mail piece) and two delivery service classes, 0 (delivery within three days from the moment of deposit) and 1 (delivery within six days), then the pointer may be the number 201. This would mean that mail piece weighting 2 ounce, having regular size and scheduled for delivery within 6 days needs to be rated. The pointer points to only one corresponding rate in the table for such rating e.g. 43 cents. This rate can be retrieved after a hash value for the entire table or its specified portion has been computed and compared with hash value (message digest) for the table or its specified portion received from the data center 112 and stored in the non-volatile memory 114 of the postage evidencing device. This approach reduces the size of the required non-volatile memory needed to store rate table information. If the hash values (message digest) match, verification is established, which means that an uncorrupted rate table was used for the rating process. The rate value together with the rate table identification are retrieved and sent to a postal revenue block formatting routine for formatting the data for printing.

The flow chart in FIG. 4 shows the activities in the postage evidencing device 114 for rating a mail piece and printing the appropriate postage payment on the mail piece 124.

Reference is now made to FIG. 4. A user enters rating parameters into the postage evidencing device 114 at 438. The postage evidencing device 114 verifies the consistency of the mail piece parameters at 440. A verification message is then sent at 442. If consistency has not been established at 443, the mail piece is rejected at 445. If consistency has been established at 443, the rate is computed at 444.

As part of computing the rate, the rate table and rate table calculation (computation) algorithm are authenticated at 446. An authentication message is sent at 448. If authentication has not been established at 450, the rate table is rejected at 452 and the process is not allowed to proceed. Thus, the rate computation noted above, will not occur. If the authenticity of the rate table has been established at 450, the computation at 444 is enabled based on the authenticated rate table and on the verified mail piece parameters. The computed rate is sent t6 the postage printing formatting module at 447.

Figure 5:
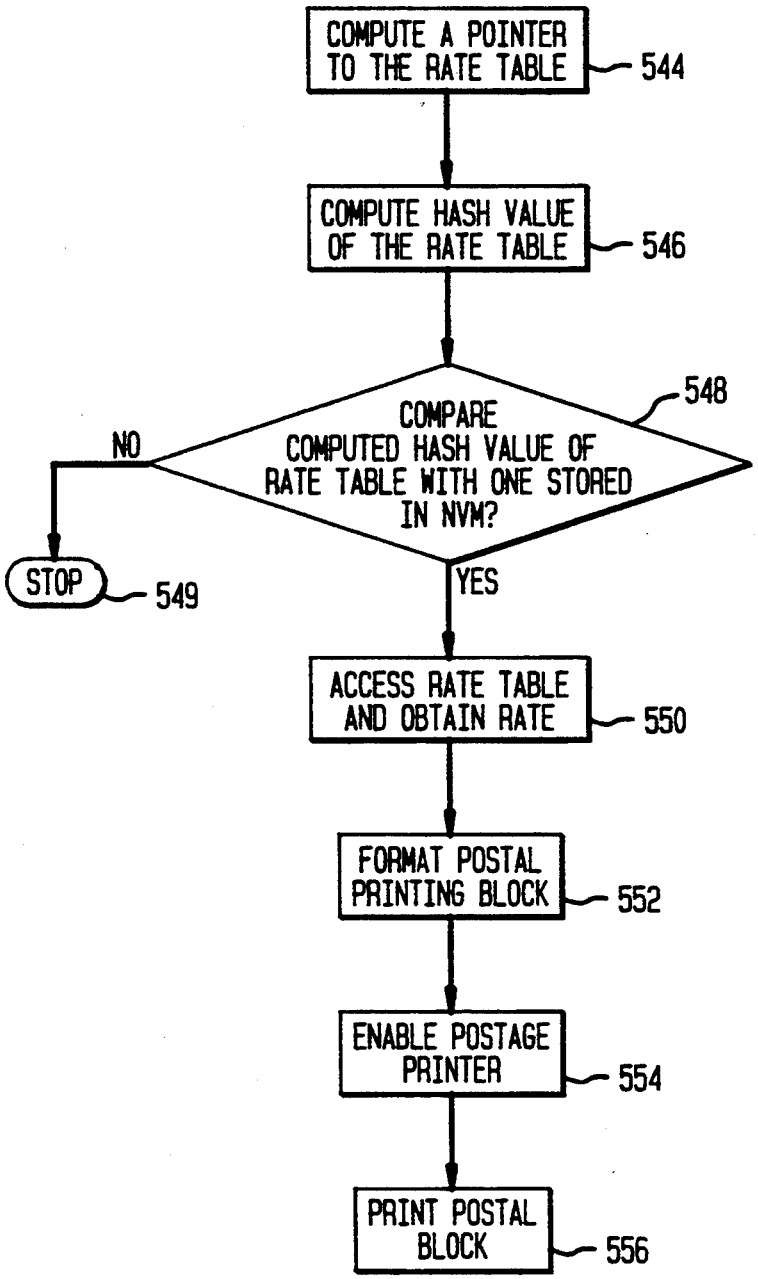
FIG. 5 is a flow chart of a sub routine within the Authenticate Rate Table and Rate Computation Algorithm block of FIG. 4; and, FIG. 6 is an imprint on a mail piece in accordance with the present invention.

Reference is now made to FIG. 5. The activities within the postage evidencing device 114 relating to authenticating the rate table as shown in FIG. 4, block 444 involves a series of steps. Initially, after receiving the verification message of consistency of the mail piece parameters, a pointer is computed to the rate table based on the parameters at 544. The hash value (message digest) of the rate table is computed at 546. The computed hash value (message digest) of the rate table is compared with the hash value (message digest) of the rate table stored in the postage evidencing device non-volatile memory at 548. If the hash values do not match at 548, the process is stopped at 549 and various alternatives can be implemented as previously noted including locking up the postage evidencing device, allowing the number of lead tries or setting a flag in the postage evidencing device NVM.

If the hash values (message digest) match at 548, access to the rate table itself is enabled at 550 and the rate involved is obtained. The rate is formatted as part of the revenue block enabling the postage evidencing device to be prepared to print at 552. The postage evidencing device printer 122 is then enabled for printing at 554 and printed at 556. The formatting of the postal revenue block will include the hash value (message digest) as well as the rate to enable later identification. All or a part of the information contained in the hash value can be utilized to determine the authenticity, validity, and currency of the rate table. Moreover, the rating vectors (rating parameters) are also printed. As previously noted the hash value may be encrypted or parameterized by a secret key. This prevents the use, for example, of improper rating vectors or rate table and the deliberate altering of the hash value or part thereof for the proper rating vectors and proper rate table.

Figure 6:
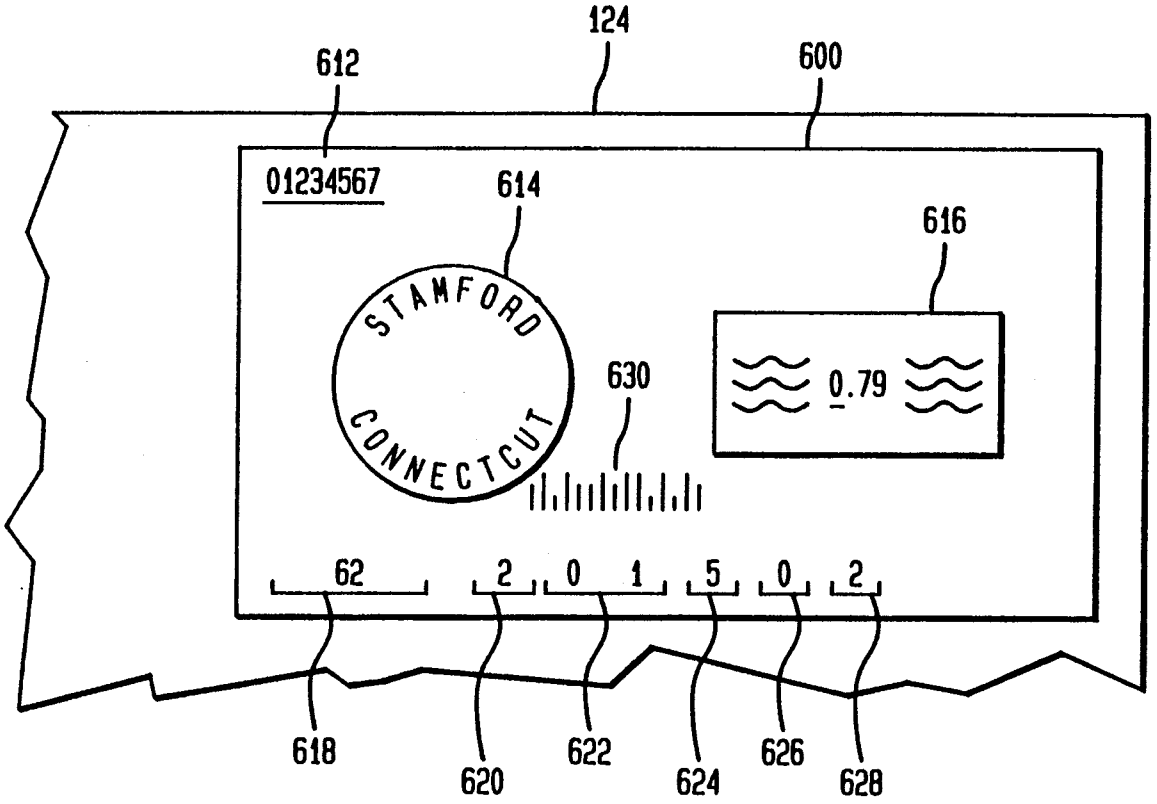

Reference is now made to FIG. 6 which is a representative mail piece with one example of the type of information which may be printed on the mail piece 124. It should be recognized that the printed information and its organization are a matter of choice and can be printed at different locations on the envelope panel or tape; moreover, the information relative to a mail piece may be stored with a mail piece and/or mailer identifier code for later processing and analysis. The stored data for later analysis can be for a single mailer or a group of mailers. The data will provide information concerning mailing patterns and information regarding rating experience for any such mailer or group of mailers.

The formatted printed postal revenue block in the present example includes a postage evidencing device identification number 612, a town circle 614, and a postage amount and suitable indicia design which may include graphics of which could change with the value and the amount 616.

Printed at the bottom of the postage printing block 600 is a sequence of information segments including the hash value or part thereof (message digest of the rate table and/or calculation algorithm 618). As noted this hash value may be encrypted or parameterized. This value provides identification of the rate table itself and/or calculation algorithm, as previously described. The weight classification of the mail piece is printed at 620 and the desired level of service is printed at 622 (one day delivery, three day delivery, 6 day delivery, etc.). The class of service, for example, registered mail is printed at 624 and a flag for oversized mail piece is printed at 626. A workshare level such as presort, barcoding, etc., is printed at 628. To facilitate rapid scanning of the printed information a barcode representation of some or all of the information previously noted is printed at 630.

It should be clearly recognized that the information printed, its location, the fonts used, the bar code types and styles are all a matter of design choice and can be modified to meet the needs and requirements of the particular postal service or private carrier or mailer involved, depending upon the conventions established for these matters. Moreover, the problem of checking of stores and retrieves from a memory such as a RAM is known in the art (see for example Checking The Correctness of Memory, by M. Blum, et al, Proceedings of the IEEE Symposium Foundations of Computer Science, pages 90–99, 1991).

The following is an example of some of the aspects of the above described systems:

The example utilizes the technique described in Contemporary Cryptology, ed. G. Simmons, IEEE Press, 1992, on page 392).

The first 64 bits of the rate table (or its suitable portion) are block-encrypted using DES and a secret key. Then the next 64 bits are added to the just produced cipher. The result is block-encrypted again using the same key, producing a new 64 bits of cipher. The procedure continues until all the 64 bits blocks of the rate table have been processed. The technique of padding with zeroes the last block (which is typically less than 64 bits) is applied.

Consider the following example. A portion of the current United States Postal Service rate table for letter mail weighing under one ounce can be represented as a string of numbers, namely: RT=110290 120267 130248 140230 150242 160239 170233.

Here each 6 digit segment represents one rate which is a function of weight, encoding, presort and prebarcoding attributes. There are total 7 possible combinations of these attributes, i.e. currently the mail could be presorted to 3 or 5 digit levels, prebarcoded or ZIP+4 numerically encoded. For example, the combination number 6 implies that the mail is presorted to 3 digit level and prebarcoded by mailer. This type of mail weighing less than 1 oz. should be postaged at $0.239 per piece. This corresponds to the segment of rate table (160239) where the first digit 1 is indicative of the weight under 1 oz., the second digit 6 is indicative of the above explained combination of encoding, presort and prebarcoding attributes and digits 0239 represent the postal rate itself.

A secure hash value of the rate table RT is generated. See Appendix A with the actual calculations. The hash value of the rate table is

6825965425726402962

The last two digits 62 of the hash value represent the rate table digital token.

The above described example allows one to reliably detect any attempt to substitute a correct rate stored in the rate table by a lower value. Thus, the deliberate alteration of the rate table described in example C can be detected and a printed evidence of such alteration can be provided to the verification party. It should be recognized that the other encryption techniques are suitable for use with the present invention. One such example is described in a paper by M. Blum et al, "Checking the correctness of Memories', Proceedings of 31st Symposium on Foundations of Computer Science, October 1990.

It should be recognized that the above described systems enables a postal service or other party to verify, authenticate and reproduce the rating process from the information imprinted on the mail piece. This allows auditing to insure that the rating process used to establish the rate was accurately and properly implemented. This includes that the correct rate table was used, consistent mail piece parameters or vectors were used as printed, the correct calculation algorithm was used, and the correct postage value was imprinted on the mail piece. The hash value (message digest) verifies that the correct rate table/calculation algorithm was used for rating, and with different vectors (parameters) such as the desired service, weight, etc., also imprinted on the mail piece, the rating process can be reconstructed. Moreover, the entire hash value 682596542572640962 (which has been parameterized with a secret key) results in the digital token being 62. This digital token 62 can be printed on the mail piece for verification purposes.

The present system thus enables an audit for each mail piece. The audit may not only determine if the mail piece was correctly or incorrectly rated but also the reason why the mail piece was incorrectly rated if such is the case. This serves as an excellent detection and thus deterrent mechanism because if a mailer or group of mailers consistently misrates the mail, (for example, consistently utilizing an improper weight or use an incorrect rate table/calculation algorithm), this can be detected. The number and nature of the detected failures for the mailer or group of mailers to properly rate the mail pieces may be stored. The postal service can take appropriate action based on specific data as to the extent and reason for misrating by a mailer or group of mailers.

The present system can be made part of the meter recharging process wherein additional funds are entered into a metering system. This is to enable the continued printing of postage when the funds within the postage evidencing device 114 are exhausted. The verification that a current rate table or rate tables is installed in the metering system can be a requirement to enable recharging of the postage evidencing device 114 with additional funds. The postage evidencing device thus can only print a limited amount of postage or other value based on improper rating or obsolete rating tables. This amount is the amount of funds within a postage evidencing device between recharging operations. This limits the risk of a postal service due to rating with improper rate tables to the amount of funds currently in the meter system.

The downloading of current rate tables when made a part of the recharging operation and can employ downloading of the current rate table hash value. The hash value would be part of other information unique to the funds recharging transaction (or other funds transaction as for example for current account meters, the reporting of funds printed by the postage evidencing device since last audit) and may be encrypted to prevent tampering. The postage evidencing device 114 would reverify the rate table using the new hash value as part of the funds reset process. If the new hash value does not match the hash value computed from the resident rate table, no postage printing would be allowed. In an alternate arrangement, the postage evidencing device 114 would calculate the hash value in the current rate table and upload the device current rate table hash value to the data center before any funds recharging or other funds transaction is authorized. If the hash value from the postage evidencing device does not match the hash value calculated at the data center, no additional funds recharging (or the funds transaction) would be authorized by the data center. In either arrangement, the postage evidencing device 114 can display a message to the user indicating that updating the rate table is required.

It should be recognized that rather than requiring the updating of the rate table or reverification of the rate table to be part of a recharging or other funds transaction, the requirement can be based on a calendar clock resident in the postage evidencing device 114. Thus, after a predetermined period of time, as for example twenty four hours, forty eight hours, seventy two hours or any other selected time period, the meter can become inoperative until a reverification that current rate tables are being utilized. In yet another arrangement this reverification can be at a point where particular value of postage has been printed or after a certain number of power up, power down cycles.

By requiring the uploading or recomputation of rate tables it is also possible to determine whether the rate table resident within the postage evidencing device has been tampered with because of the lack of appropriate hash value, for either a current rate table or a previously valid rate table. In such case, meter operation can be inhibited either by the failure to enable recharging of the meter or by downloading a data code which inhibits operation of the meter.

It should still be understood that the arrangement described above in connection with insuring the integrity of the data loaded into the postage evidencing device 114 can be mailing data other information within the postage evidencing device 114 or peripherals to the postage evidencing device. For example, if a mailing list is downloaded into the postage evidencing device by the techniques described above, the hash values can be computed during the operation to insure the data was not corrupted during the loading process or the utilization of the data during operation of the postage evidencing device. The hash values can be generated each time a specified number of transactions (of any type) occur. The hash values would be stored in the postage evidencing or in the data center or other data repository. A postal service or a carrier or other party would thereby be able to detect and determine corruption of the data by querying the postage evidencing device or peripheral. The sequence of hash values stored would allow a determination of when and where tampering occurred depending on the nature of the parameters used to generate the hash value.

While the present invention has been disclosed and described with reference to the specific embodiments described herein, it will be apparent, as noted above and from the above itself that variations and modifications may be made therein. It is, thus, intended in the following claims to cover each variation and modification that falls within the true spirit and scope of the present invention.

APPENDIX A

RT = 110290 120267 130248 140230 150242 160239 170233

APPENDIX A-continued

1. Convert RT into binary value RTB
RTB = 0001 0100 0100 0001 1101 0001 0000 1000 0100 1110 1101 1100 1101 0101 0010 1110 1001 1011 1000 0010 1100 0100 1000 1100 0010 0101 0011 1000 1010 1010 1111 1101 0010 1011 1001
2. Take first 64 bits of RTB (B1) and encrypt it with DES key K = 1234577777. Result is A1.
Leftmost 32 bits of output = 3435858444 (CCCB0A0CH)
Rightmost 32 bits of output = 4259691368 (FDE5BB68H)
A1 = CCCB 0A0C FDE5 BB68 (hex)
3. Take next 64 bits of RTB (B2) and calculate A1 XOR B2
A1 = CCCB 0A0C FDE5 BB68 (hex)
B2 = 1D10 84ED CD52 E9B8 (hex)
A1 XOR B2 = D1DB 8EE1 30B7 52D0 (hex)
(A1 XOR B2)2 = 3,520,827,105 (decimal, leftmost 32 bits)
(A2 XOR B2)1 = 827,320,656 (decimal, rightmost 32 bits)
4. Encrypt A1 XOR B2 with DES key K = 1234577777. Result is A2.
Leftmost 32 bits of output = 3323549928 (C61958E8H)
Rightmost 32 bits of output = 705585280 (2A0E6080H)
A2 = C619 58E8 2A0E 6080 (hex)
5. Take remaining bits of RTB (B3) and calculate A3 = A2 XOR B3.
A2 = C619 58E8 2A0E 6080 (hex)
B3 = 0000 0000 0000 0144 (hex)
A3 = C619 58E8 2A0E 61C4
(A2 XOR B3)2 = 3,323,549,928 (decimal, leftmost 32 bits)
(A2 XOR B3)1 = 705,585,604 (decimal, rightmost 32 bits)
6. Encrypt A3 with DES key K = 1234577777. The result is:
Leftmost 32 bits of output = 1589293923 (5EBAB363H)
Rightmost 32 bits of output = 2709860754 (A1853192H)
RESULT = 5EAA B363 A185 3192 (hex)
= 6,825,965,425,726,402,962 (decimal)

What is claimed is:

1. A postal rating system comprising:

a postal rating device having non-volatile storage means;

means for transmitting a postal rate table to said postal rating device such that said postal rate table is stored in said rating device non-volatile memory;

means for transmitting to said postal rating device a hash code such that said hash code is stored in said rating device non-volatile memory, said hash code based on information from said rating table;

means in said postal rating device for generating a hash code based on information from said received rate table stored in said rating device non-volatile memory; and means for comparing the received hash code with the generated hash code.

2. A postal rating system as defined in claim 1 wherein said transmitted hash code is an encrypted hash code and including means in said rating device for decrypting the encrypted hash code and comparing the decrypted hash code with the generated hash code.

3. A postal system as defined in claim 2 wherein the received hash code and the generated hash code are each based upon the entire rate table.

4. A postal system as defined in claim 2 wherein said transmitted hash code and said transmitted rate table each includes data as to the time period when the rate table is valid.

5. A postage evidence device comprising:

means for storing a postal rate table in a non-volatile memory;

means for storing a hash code based on information from the rate table in said non-volatile memory;

means for receiving a request for printing of postage value;

means for recomputing the hash code from said information from said rate table stored in said non-volatile memory;

means for comparing the recomputed hash code based with said hash code stored in said non-volatile memory; and means for comparing said recomputed hash code and said stored hash code.

6. A postage evidencing device as defined in claim 5 further including:

means for printing at least one of said stored and said recomputed printing hash codes on a mail piece;

means for printing said mail piece rating parameters on said mail piece such that a verifying party can reconstruct the rating process and determine if rating inaccuracy occurred.

7. A postage evidencing device as defined in claim further including means for encrypting said hash code such that said printing means is enabled to print an encrypted hash code on said mail piece.

8. A system for verifying the accuracy of postal rating, comprising:

means for scanning a mail piece to detect a hash code printed on a mail piece and rating parameters also printed on the mail piece;

means for recomputing the rating process to determine the rating accuracy; and, means for determining the correctness of said rating for said scanned mail piece.

9. A system as defined in claim 8 further including means for storing a profile of a mailer based on information from said determining means to provide data concerning rating activities for a series of mail pieces.

10. A mail piece having imprinted thereon a postal rate based on a postal rate table, the improvement comprising imprinting on said mail piece a code based on information derived from the postal rate table and which provides an identification of the rate table.

11. A mail piece as defined in claim 10 wherein said code imprinted on said mail piece is a value derived from processing said rate table information with a function which precludes recreating said rate table information based solely on said imprinted value.

12. A mail piece as defined in claim 10 wherein said code is encrypted.

13. A mail piece as define in claim 11 wherein said function is a hash function.

14. A mail piece as defined in claim 13 wherein said code is encrypted.

15. A mail piece as defined in claim 13 wherein said code imprinted on said mail piece is related to a hash value.

16. A mail piece as defined in claim 15 wherein said code is an encrypted hash value.

17. A mail piece as defined in claim 15 wherein the hash value is imprinted in machine readable form.

18. A mail piece as defined in claim 17 wherein said hash value is imprinted in bar code format.

19. A mail piece as defined in claim 18 wherein said bar code format is a bar half bar code format.

20. A mail piece as defined in claim 19 wherein said value is an encrypted hash value.

21. A method for postal rating, comprising the steps of:

transmitting a postal rate table to a rating device;

transmitting to said rating device a code, said code based on information from said rating table;

generating a code based on information from the received rate table; and comparing the received code with the generated code.

22. A method as defined in claim 21 wherein said received code and said generated code are hash code.

23. A method as defined in claim 22 wherein said transmitted hash code is an encrypted hash code and including the further steps of decrypting the encrypted hash code and comparing the decrypted hash code with the generated hash code.

24. A method as defined in claim 21 where the transmitted and said generated codes are based upon the entire rate table.

25. A method of printing postage evidence, comprising the steps of:

storing a postal rate table in a non-volatile memory;

storing a code based on information from the rate table in said non-volatile memory;

receiving a request for printing of postage value;

recomputing the code from said information from said rate table stored in said non-volatile memory; and comparing said recomputed code and said stored code.

26. A method as defined in claim 25 wherein said stored code and said recomputed code are each hash codes.

27. A method of printing postage as defined in claim 25 further including the steps of:

printing said code on a mail piece;

printing said mail piece rating parameters on said mail piece to enable reconstruction of the rating process from information imprinted on said mail piece.

28. A method as defined in claim 27 wherein said code is encrypted and said encrypted code is printed.

29. A method as defined in claim 25 further including printing a postage rate, printing the date of printing the postage rate and printing said code on said mail piece, said code containing data as to the time period when said rate table is valid.

30. A method as defined in claim 29 wherein said code is encrypted and said encrypted code is printed.

31. A system for verifying the accuracy of postal rating, comprising the steps of:

scanning a mail piece to detect a code for a mail piece printed on said mail piece and rating parameters also printed on said mail piece;

recomputing the rating process to determine the rating accuracy; and determining the correctness of said rating for said scanned mail piece.

32. A method as defined in claim 31 wherein said code is a hash code.

33. A method as defined in claim 32 where in said code is an encrypted code and including the further steps of decrypting said encrypted code.

34. A system as defined in claim 31 further including storing a profile of a mailer or group of mailers based on scanned data concerning rating activities for a series of mail pieces for said mailer or group of mailers.

35. A method as defined in claim 23 wherein said transmitted hash code and said transmitted rate table each include data as to the rate table validity time period.

36. A postal rating system comprising:

a postal rating device having secure storage means;

means for transmitting a postal rate table to said postal rating device such that said postal rate table is stored in said rating device secure storage means;

means for transmitting to said postal rating device a hash code such that said hash code is stored in said rating device secure storage means, said hash code based on information from said rating table;

means in said postal rating device for generating a hash code based on information from said received rate table stored in said rating device secure storage means memory; and means for comparing the received hash code with the generated hash code.

37. A postal rating system as defined in claim 36 wherein said transmitted hash code is an encrypted hash code and including means in said rating device for decrypting the encrypted hash code and comparing the decrypted hash code with the generated hash code.

38. A postal system as defined in claim 37 wherein the received hash code and the generated hash code are each based upon the entire rate table.

39. A postal system as defined in claim 37 wherein said transmitted hash code and said transmitted rate table each includes data as to the time period when the rate table is valid.

40. A method of printing postage evidence, comprising the steps of:

storing a postal rate table;

storing a code based on information from the rate table;

receiving a request for printing of postage value;

recomputing the code from said information from said stored rate table; and comparing said recomputed code and said stored code.

41. A method as defined in claim 40 wherein said stored code and said recomputed code are each hash codes.

42. A method of printing postage as defined in claim 40 further including the steps of:

printing said code on a mail piece; and, printing said mail piece rating parameters on said mail piece to enable reconstruction of the rating process from information imprinted on said mail piece.

43. A method as defined in claim 42 wherein said code is encrypted and said encrypted code is printed.

44. A method as defined in claim 40 further including printing a postage rate, printing the date of printing the postage rate and printing said code on said mail piece, said code containing data as to the time period when said rate table is valid.

45. A method as defined in claim 44 wherein said code is encrypted and said encrypted code is printed.

46. A method for a mailing system, comprising the steps of:

generating a request for recharging a postage evidencing device with additional postage value to be printed;

determining the validity of a rate table associated with said postage evidencing device; and, enabling recharging of said postage evidencing device if said rate table is determined to be valid.

47. A method as defined in claim 46 wherein said steps of determining includes said postage evidencing device transmitting to a remote location a hash code value of a rate table currently associated with said postage evidencing device.

48. A method as defined in claim 46 wherein said steps of determining includes transmitting to said postage evidencing device a hash code value of a currently valid rate table.

49. A method for a mailing system, comprising the steps of:

determining the validity of a rate table associated with a postage evidencing device; and enabling operation of said postage evidencing device if said rate table is determined to be valid.

50. A method as defined in claim 49 wherein said determining step is initiated periodically based on a calendar clock value in said postage evidencing device.

51. A method as defined in claim 49 wherein said determining step is initiated based on the amount of postage printed by said postage evidencing device.

52. A mailing system, comprising the steps of:

determining the validity of mailing data associated with a postage evidencing device; and enabling operation of said postage evidencing device if said mailing data is determined to be valid.

53. A method as defined in claim 52 wherein said determining steps includes generating a hash code value based on said mailing data.

54. A method as defined in claim 53 wherein said hash code value is respectively generated and stored for later retrieval and verification.

55. A method as defined in claim 54 wherein said hash code values are stored in a secure memory.

* * * * *